US010047419B2

(12) United States Patent
Ivarsson et al.

(10) Patent No.: US 10,047,419 B2
(45) Date of Patent: Aug. 14, 2018

(54) FERRITIC STAINLESS STEEL

(71) Applicant: OUTOKUMPU OYJ, Espoo (FI)

(72) Inventors: Bo Ivarsson, Avesta (SE); Mirva Kujansuu, Tornio (FI); Huiping Liu, Linköping (SE); Fredrik Olsson, Avesta (SE); Rachel Pettersson, Norrtälje (SE); Pascale Sotto Vangeli, Avesta (SE)

(73) Assignee: Outokumpu Oyj, Helsinki (FI)

( * ) Notice: Subject to any disclaimer, the term of this patent is extended or adjusted under 35 U.S.C. 154(b) by 163 days.

(21) Appl. No.: 14/410,225

(22) PCT Filed: Jun. 26, 2013

(86) PCT No.: PCT/FI2013/050708
§ 371 (c)(1),
(2) Date: Dec. 22, 2014

(87) PCT Pub. No.: WO2014/001644
PCT Pub. Date: Jan. 3, 2014

(65) Prior Publication Data

US 2015/0337418 A1 Nov. 26, 2015

(30) Foreign Application Priority Data

Jun. 26, 2012 (FI) ..... 20120215

(51) Int. Cl.

| | |
|---|---|
| ***C22C 38/54*** | (2006.01) |
| ***C22C 38/50*** | (2006.01) |
| ***C22C 38/48*** | (2006.01) |
| ***C22C 38/44*** | (2006.01) |
| ***C22C 38/42*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/00*** | (2006.01) |
| ***C22C 38/02*** | (2006.01) |
| ***C22C 38/04*** | (2006.01) |
| *C21D 6/00* | (2006.01) |

(52) U.S. Cl.

CPC ..... *C22C 38/54* (2013.01); *C22C 38/001* (2013.01); *C22C 38/002* (2013.01); *C22C 38/004* (2013.01); *C22C 38/02* (2013.01); *C22C 38/04* (2013.01); *C22C 38/20* (2013.01); *C22C 38/22* (2013.01); *C22C 38/26* (2013.01); *C22C 38/28* (2013.01); *C22C 38/32* (2013.01); *C22C 38/42* (2013.01); *C22C 38/44* (2013.01); *C22C 38/48* (2013.01); *C22C 38/50* (2013.01); *C21D 6/002* (2013.01)

(58) Field of Classification Search

CPC ..... C21D 6/002; C22C 38/00
USPC ..... 148/326; 420/61, 57
See application file for complete search history.

(56) References Cited

U.S. PATENT DOCUMENTS

| | | | | |
|---|---|---|---|---|
| 8,062,584 | B2 * | 11/2011 | Hamada | C21D 6/002 420/34 |
| 2006/0172582 | A1 | 8/2006 | Fujii et al. | |
| 2012/0111529 | A1 * | 5/2012 | Oku | C22C 38/001 165/41 |

FOREIGN PATENT DOCUMENTS

| | | | |
|---|---|---|---|
| CN | 101328561 | A | 12/2008 |
| EP | 0478790 | A1 | 4/1992 |
| JP | 3474829 | B2 | 11/2001 |
| JP | 2008285693 | A | 11/2008 |
| JP | 2009197307 | A | 9/2009 |
| JP | 2009235572 | A | 10/2009 |
| JP | 2010236001 | A | 10/2010 |
| KR | 20120064330 | A | 6/2012 |

OTHER PUBLICATIONS

International search report from corresponding PCT Application No. PCT/FI2013/050708, dated Sep. 24, 2013, 1 pg.
Search Report prepared by the National Board of Patents and Registration of Finland for FI 20120215, dated Mar. 8, 2013, 2 pages.

* cited by examiner

*Primary Examiner* — Jie Yang
(74) *Attorney, Agent, or Firm* — Chernoff Vilhauer LLP

(57) ABSTRACT

The invention relates to a ferritic stainless steel having enhanced high temperature strength and good resistance to high cycle fatigue, creep and oxidation for use in high temperature service, for components such as automotive exhaust manifolds. The steel contains in weight % less than 0.03% carbon, 0.05-2% silicon, 0.5-2% manganese, 17-20% chromium, 0.5-2% molybdenum, less than 0.2% titanium, 0.3-1% niobium, 1-2% copper, less than 0.03% nitrogen, 0.001-0.005% boron, the rest of the chemical composition being iron and inevitable impurities occurring in stainless steels.

9 Claims, No Drawings

FERRITIC STAINLESS STEEL

This is a national stage application filed under 35 USC 371 based on International Application No. PCT/FI2013/050708, filed Jun. 26, 2013, and claims priority under 35 USC 119 of Finnish Patent Application No. 20120215 filed Jun. 26, 2012.

This invention relates to a ferritic stainless steel having enhanced high temperature strength and good resistance to high cycle fatigue, creep and oxidation as well as corrosion resistance for use in high temperature service, for components such as automotive exhaust manifolds.

The standardized ferritic stainless steel EN 1.4509, containing less than 0.03 weight % carbon, 17.5-18.5 weight % chromium, 0.1-0.6 weight % titanium, less than 1 weight % silicon, less than 1 weight % manganese, and a niobium content from (3×C+0.30) to 1.0 weight % where C is the carbon content in weight percent, is generally used for tubular products in automobile industry and in process equipment like heat exchangers. The high mechanical strength at elevated temperatures (up to 850° C.) makes this ferritic stainless steel material suitable for use in the front end (close to the engine) of an exhaust system. Furthermore, the added chromium gives it rather good corrosion properties which make the steel EN 1.4509 also appropriate to be used in mufflers in an automotive exhaust system. The proof strength $R_{p0.2}$ is about 300-350 MPa and the tensile strength $R_m$ is about 430-630 MPa.

The JP patent application 2001-316773 relates to a heat resistant ferritic stainless steel for a catalyst carrier having a composition containing in weight 0.003 to 0.02% C, less than 0.02% N, 0.1 to 2% Si, less than 3% Mn, less than 0.04% P, less than 0.02% S, 10 to 25% Cr, 1 to 2.5% Al, Ti: 3×(C+N) to 20×(C+N) % and Al+0.5×Si: 1.5 to 2.8%, and the balance Fe with inevitable impurities. Further, the addition of one or more elements selected from 0.1 to 2.5% Mo, 0.1 to 2.5% Cu, 0.1 to 2.5% Ni, 0.01 to 0.5% Nb, 0.05 to 0.5% V, 0.0005 to 0.005% B, 0.0005 to 0.005% Mg, 0.0005 to 0.005% Ca, and 0.001 to 0.01% rare earth metals, and use of a work-hardened layer on the surface, are preferable.

The JP patent application 2008-285693 describes a ferritic stainless steel having good thermal fatigue resistance for a component of an automotive exhaust system to be placed at the temperature of about 950° C. for a long time. The steel contains in weight % 0.02% or less C, 1.5% or less Si, 1.5% or less Mn, 0.04% or less P, 0.03% or less S, 0.2 to 2.5% Al, 0.02% or less N, 13 to 25% Cr, 0.5% or less Ni, 0.5% or less V, more than 0.5 to 1.0% Nb, 3×(C+N) to 0.25% Ti, and the balance Fe with unavoidable impurities. The steel sheet may further contain, by weight %, 0.0003 to 0.0050% B, 0.3 to 2.5% Mo and 0.1 to 2.0% Cu.

The ferritic stainless steels in the JP patent applications 2001-316773 and 2008-285693 contain aluminium, not only as a deoxidizing element, but also as solid-solution strengthening element and to enhance the formation of a protective oxide film on the steel surface. However, excess aluminium content will decrease the processability of the steel, thus making the steel difficult to manufacture and increasing the manufacturing costs.

The JP publication 2009-197307 describes a ferritic stainless steel which contains in weight % <0.015% C, <0.1% Si, <2.0% Mn, 14-20% Cr, <1.0% Ni, 0.8-3.0% Mo, 1.0-2.5% Cu, <0.015% N, 0.3-1.0% Nb, 0.01-0.3% Al, 1.0-5.0% W in the total amount with Mo so that the sum of (Mo+W) is at the range of 3.0-5.8%, optionally <0.25% Ti, 0.0005-0.003% B, <0.5% V, <0.5% Zr, <0.08% REM (rare earth metal) and <0.5% Co. In this stainless steel the silicon content is very low. Furthermore, the sum of the contents for molybdenum and tungsten is 3.0-5.8 weight %. This sum of molybdenum and tungsten contents is not just optional. Molybdenum and tungsten are considered expensive elements and adding large amounts of them, such as 3% or more, will make the manufacturing costs very high.

The JP 2009-235572 publication relates to a ferritic stainless steel having the chemical composition in weight % <0.015% C, <0.2% Si, <0.2% Mn, 16-20% Cr, <0.1% Mo, 1.0-1.8% Cu, <0.015% N, <0.15% Ti, 0.3-0.55% Nb, 0.2-0.6% Al, optionally <0.5% Ni, <0.003% B, <0.5% V, <0.5% Zr, <0.1% W, <0.08% REM (rare earth metal) and <0.5% Co. Also in this JP publication aluminium is used as one alloying component that makes the manufacturing of that kind of stainless steel more complex and more expensive because the stainless steel shall be manufactured by a special treatment because of aluminium. This steel has also very low content for silicon and says that it improves the cyclic oxidation resistance but does not say anything about changes in isothermal oxidation resistance for which silicon is known to be very beneficial.

The KR publication 2012-64330 describes a ferritic stainless steel having the chemical composition in weight % <0.05% C, <1.0% Si, <1.0% Mn, 15-25% Cr, <2.0% Ni, <1.0% Mo, <1.0% Cu, <0.05% N, 0.1-0.5% Nb, 0.001-0.01% B, <0.1% Al, 0.01-0.3% V, 0.01-0.3% Zr. This KR publication mentions an automotive exhaust manifold part as one of the use for this ferritic stainless steel. However, this KR publication 2012-64330 does not indicate anything about the high cycle fatigue which is very important property in automotive exhaust systems. This is based on that the copper content, very important for the high cycle fatigue resistance, is very low.

The object of the present invention is to eliminate some drawbacks of the prior art and to achieve a new and improved ferritic stainless steel to be used in conditions where enhanced high temperature strength and good resistance to high cycle fatigue, creep and oxidation are required for components such as automotive exhaust manifolds and which ferritic stainless steel is manufactured cost-effectively. The essential features of the invention are enlisted in the appended claims.

According to the present invention the chemical composition of the ferritic stainless steel is in weight % less than 0.03% carbon, 0.05-2% silicon, 0.5-2% manganese, 17-20% chromium, 0.5-2% molybdenum, less than 0.2% titanium, 0.3-1% niobium, 1-2% copper, less than 0.03% nitrogen, 0.001-0.005% boron, the rest of the chemical composition being iron and inevitable impurities occurring in stainless steels.

Optionally one or more of the alloying elements containing aluminum, vanadium, zirconium, tungsten, cobalt and nickel as well as one or more rare earth metal (REM) can be added in the ferritic stainless steel of the invention.

In the ferritic stainless steel according to the invention the proof strength $R_{p0.2}$ is about 450-550 MPa and the tensile strength $R_m$ is about 570-650 MPa.

The ferritic stainless steel according to the invention has good resistance to high temperature corrosion under cyclic conditions, good high temperature strength, and good resistance to high cycle fatigue. The resistance to high cycle fatigue is improved in relation to the standardized EN 1.4509 ferritic stainless steel such that the lifetime in the ferritic stainless steel of the invention when exposed to a mean stress of 60 MPa with amplitude 60 MPa at 700° C. in general, is more than doubled. The ferritic stainless steel according to the invention achieves a load-bearing capacity with a thinner material when comparing with the steels of the prior art. These properties in the ferritic stainless steel of the invention are achieved by adding molybdenum, copper and boron and using of controlled stabilization with niobium and titanium contents compared to the standardized EN 1.4509 ferritic stainless steel.

The ferritic stainless steel according to the invention has also good corrosion resistance both in chloride and in sulfur containing environments. The pitting potential ($E_{pt}$) in 1 M sodium chloride (NaCl) at the temperature of 25° C. is about 300-450 $mV_{SCE}$ and the repassivation potential ($E_{rp}$) in the same conditions −80 $mV_{SCE}$. The critical current density ($i_c$) in 0.5% sulphuric acid ($H_2SO_4$) at the temperature of 30° C. is about 0.8 $mA/cm^2$ and the transpassive potential ($E_{tr}$) in the same conditions about 900-1000 $mV_{SCE}$. These properties of the ferritic stainless steel according to the invention are achieved by adding molybdenum and copper and give an improved corrosion resistance as compared with the standardized EN 1.4509 ferritic stainless steel.

The effects and contents of each individual element in the ferritic stainless steel according to the invention are described in the following, the contents being in weight %.

Carbon (C) is an important element for maintaining mechanical strength. However, if a large amount of carbon is added, carbides precipitate thus reducing the corrosion resistance. Therefore, in the present invention the carbon content is limited to less than 0.03%, preferably less than 0.025% and more preferably less than 0.02%.

Silicon (Si) is a ferrite stabilizer and raises the oxidation resistance and is therefore useful in heat resistant stainless steel. Silicon has also a deoxidation effect and is used in refining, and therefore 0.05% or more silicon is inevitable. However, if the silicon content exceeds 2%, the workability is decreased. Accordingly, in the present invention the content of silicon is set to 0.05%-2%, preferably 0.8-1%.

Manganese (Mn) is intentionally added in carbon steels to mitigate sulfur-induced hot shortness and is typically present in stainless steels. If there is an excessive content of manganese, the steel becomes hard and brittle, and the workability is significantly reduced. Further, manganese is an austenite stabilizer, and, if added in large amount, it facilitates generation of the martensite phase, thus degrading the workability. Accordingly, the content of manganese is set to between 0.5-2.0% in the steel of the invention.

Chromium (Cr) is the main addition to ensure oxidation resistance, steam corrosion resistance, and corrosion resistance in exhaust gases. It also stabilizes the ferrite phase. To improve the hot corrosion and oxidation resistance at high temperature, a chromium content of more than 17% is needed. However, excessive chromium favours the formation of undesirable intermetallic compounds such as sigma phase and is therefore limited to 20%. Accordingly, the chromium content is set to 17-20%, preferably 18-19%.

Molybdenum (Mo) is an important element, like chromium, for maintaining corrosion resistance of the steel. Molybdenum also stabilizes the ferrite phase and increases the high temperature strength by solid solution hardening. In order to obtain this effect, a minimum of 0.5% is needed. However, large amount of molybdenum generates intermetallic compounds such as sigma and chi phase and impairs toughness, strength, and ductility and is therefore limited to 2%. Accordingly, the molybdenum content is set to 0.5-2%, preferably 0.7-1.8%.

Copper (Cu) induces substitutional solid solution hardening effects to improve tensile, proof and creep strength and the high cycle fatigue resistance in the temperature range 500-850° C., based on a fine dispersion precipitation hardening. In order to obtain this effect, a copper content of 1% is necessary. However, too much copper decreases the workability, low-temperature toughness and weldability and an upper limit of Cu is set to 2%. Accordingly, copper content is set to 1-2% and preferably 1.2-1.8%.

Nitrogen (N) is added to ensure precipitation strengthening through carbo-nitrides at high temperature. However, when added in excess, nitrogen degrades the workability and low-temperature toughness and weldability. In the invention, the nitrogen content is limited to less than 0.03%, preferably less than 0.025% and more preferably less than 0.02%.

Boron (B) is added in small quantities to improve hot workability and the creep strength. The preferred levels for boron are 0.001-0.005%.

Sulphur (S) can form sulphide inclusions that influence pitting corrosion resistance negatively. The content of sulphur should therefore be limited to less than 0.005%.

Phosphorus (P) deteriorates hot workability and can form phosphide particles or films that influence corrosion resistance negatively. The content of phosphorus should therefore be limited to less than 0.05%, preferably less than 0.04%.

Oxygen (O) improves weld penetration by changing the surface energy of the weld pool but can have a deleterious effect on toughness and hot ductility. For the present invention the advisable maximum oxygen level is less than 0.01%.

Calcium (Ca) may be introduced into the stainless steel in conjunction with additions or rare earth metals but should be limited to 0.003%

The "micro-alloying" elements titanium (Ti) and niobium (Nb) belong to a group of additions so named because they significantly change the steels properties at low concentrations. Many of the effects depend on their strong affinity for carbon and nitrogen. Niobium is beneficial to the increase of high temperature strength by solid solution hardening and can also hinder ferritic grain coarsening during annealing and/or welding. It may also improve the creep resistance by forming fine dispersions of Laves phase $Fe_2Nb$. In the present invention, niobium is limited to the range 0.3-1%, while titanium is limited to less than 0.2%.

Aluminium (Al) is used as a deoxidizer in steel manufacturing and can improve high-temperature oxidation. However, excessive addition deteriorates workability, weldability and low-temperature toughness. Accordingly, aluminium is limited to less than 0.2%.

Vanadium (V) contributes to high-temperature strength. However, excessive use of vanadium impairs workability and low-temperature toughness. Accordingly, the vanadium content should be less than 0.5%.

Zirconium (Zr) contributes to improvement of high-temperature strength and oxidation resistance. However, excessive addition impairs toughness and should be limited to less than 0.5%.

Tungsten (W) has similar properties as molybdenum and can sometimes replace molybdenum. However, tungsten can promote intermetallic phases such as sigma and chi phase and should be limited to less than 3%. When tungsten replaces molybdenum, the total amount of the sum (Mo+W) shall be limited to 3%.

Cobalt (Co) and nickel (Ni) may be added to contribute to low-temperature toughness. They inhibit grain growth at elevated temperatures and considerably improve the retention of hardness and hot strength. However, excessive addition thereof lowers the cold elongation and, therefore, both respective elements should be limited to less than 1%.

Rare earth metals (REM), such as cerium (Ce) and yttrium (Y), can be added in small quantities in the ferritic stainless steel to improve the high-temperature oxidation resistance. However, rate excessive addition thereof may deteriorate other properties. The preferred levels are for each REM less than 0.01%.

The ferritic stainless steel according to the invention was tested in two laboratory heats (A, B), which have been fabricated as cold rolled 1.5 mm thick sheets. As a reference, two laboratory heats of the 1.4509 ferritic stainless steel (C, D) are also tested. In some tests, also the values for the 1.4509 ferritic stainless steel from full scale production (1.4509) are used as reference. The chemical compositions of the tested laboratory heats are listed in Table 1.

TABLE 1

| Heat | Contents in weight % | | | | | | |
|---|---|---|---|---|---|---|---|
| A | C | Si | Mn | P | S | Cr | Ni |
| | 0.007 | 0.26 | 0.79 | 0.007 | 0.005 | 18.5 | <0.1 |
| | Mo | Ti | Nb | Cu | N | B | O |
| | 0.97 | 0.12 | 0.56 | 1.52 | 0.0098 | 0.0042 | 0.0091 |
| B | C | Si | Mn | P | S | Cr | Ni |
| | 0.008 | 0.25 | 0.78 | 0.007 | 0.005 | 18.4 | <0.1 |
| | Mo | Ti | Nb | Cu | N | B | O |
| | 0.98 | 0.11 | 0.55 | 1.53 | 0.004 | 0.004 | 0.0058 |
| C* | C | Si | Mn | P | S | Cr | Ni |
| | 0.021 | 0.32 | 0.67 | 0.007 | 0.005 | 17.8 | <0.1 |
| | Mo | Ti | Nb | Cu | N | B | O |
| | 0.01 | 0.44 | 0.56 | 0.01 | 0.0141 | 0.0005 | 0.0047 |
| D* | C | Si | Mn | P | S | Cr | Ni |
| | 0.022 | 0.31 | 0.6 | 0.007 | 0.004 | 17.7 | <0.1 |
| | Mo | Ti | Nb | Cu | N | B | O |
| | 0.01 | 0.41 | 0.56 | 0.01 | 0.0133 | <0.0005 | 0.0055 |

*alloy outside the invention

The reference heats (C and D) and the heats (A and B) according to the invention are different from each other when comparing at least the molybdenum, copper and titanium contents.

The proof strengths $R_{p0.2}$, $R_{p1.0}$ and the tensile strength $R_m$ as well as the elongation were determined for the tested materials and the test results are described in Table 2.

TABLE 2

| Heat | $R_{p0.2}$ (MPa) | $R_{p1.0}$ (MPa) | $R_m$ (MPa) | $A_g$ (%) | $A_{50}$ (%) |
|---|---|---|---|---|---|
| 1.4509 | 369 | 390 | 490 | | 31 |
| A | 524 | 536 | 647 | 12 | 19 |
| B | 511 | 525 | 633 | 12 | 21 |
| C | 295 | 317 | 459 | 12 | 14 |
| D | 290 | 312 | 460 | 18 | 29 |

The proof strength $R_{p0.2}$, and $R_{p1.0}$ values and the tensile strength $R_m$ values of the laboratory heats A and B according to the invention are superior to both the laboratory heats C and D of 1.4509 and the full scale production 1.4509 ferritic stainless steel.

The fatigue resistance of the ferritic stainless steel according to the invention was tested in a high cycle fatigue (HCF) test. In this test specimens of the steel were subjected to a pulsating load with a stress ratio R of 0.01 at the temperature of 700° C. This means that stress was kept at 60 MPa with an amplitude of 60 MPa. The test results concerning HCF tests are shown in Table 3.

TABLE 3

| .Heat | Failure (cycles) |
|---|---|
| A sample 1 | 1417200 |
| A sample 2 | 814000 |
| 1.4509 - sample 1 | 204800 |
| 1.4509 - sample 2 | 208000 |

The oxidation resistance of the ferritic stainless steel according to the invention was tested in furnaces and micro thermobalances under various conditions and the results are summarized in Tables 4-7. The test materials were the heats A, C (laboratory heat of the 1.4509) and a full scale production heat of 1.4509.

Table 4 shows results for the growth mass change of oxidation at different temperatures with 48 hours testing time.

TABLE 4

| Heat | 750° C. (mg/cm$^2$) | 800° C. (mg/cm$^2$) | 850° C. (mg/cm$^2$) | 900° C. (mg/cm$^2$) | 950° C. (mg/cm$^2$) | 1000° C. (mg/cm$^2$) |
|---|---|---|---|---|---|---|
| A | 0.1 | 0.2 | 0.4 | 1.1 | 1.5 | 3.2 |
| C | 0.2 | 0.4 | 0.7 | 1.3 | 2.1 | 3.0 |
| 1.4509 | 0.1 | 0.1 | 0.4 | 0.6 | 1.2 | 1.9 |

In Table 5 it is shown results from a long term growth mass change of oxidation at the temperature 900° C. with a total of 3000 hours testing time and intermediate evaluations at 100 hours and 300 hours.

TABLE 5

| Heat | 100 h (mg/cm$^2$) | 300 h (mg/cm$^2$) | 3000 h (mg/cm$^2$) |
|---|---|---|---|
| A | 0.7 | 0.2 | 2.7 |
| C | 0.9 | 1.4 | 3.9 |
| 1.4509 | 0.6 | 1.1 | 2.7 |

The results from cyclic growth mass change of oxidation testing at the temperature 900° C. are shown in Table 6. The total test time is 300 hours with 1 hour at 900° C. and 15 minutes at room temperature in each cycle. Intermediate evalutions were performed after 100 hours and 200 hours.

TABLE 6

| Heat | 100 h (mg/cm$^2$) | 200 h (mg/cm$^2$) | 300 h (mg/cm$^2$) |
|---|---|---|---|
| A | 0.6 | 0.8 | 0.9 |
| C | 0.6 | 0.9 | 1.0 |
| 1.4509 | 0.3 | 0.5 | 0.7 |

Table 7 shows results from wet growth mass change of oxidation testing at the temperature 900° C. in 35% moisture with a total test time of 168 hours and intermediate evaluations at 50 hours and 100 hours.

TABLE 7

| Heat | 50 h (mg/cm$^2$) | 100 h (mg/cm$^2$) | 168 h (mg/cm$^2$) |
|---|---|---|---|
| A | 0.3 | 0.4 | 0.6 |
| C | 0.9 | 1.3 | 1.5 |
| 1.4509 | 0.8 | 0.9 | 1.1 |

The oxidation testing results for the laboratory heat (A) according to the invention are similar or superior to the laboratory material of 1.4509 (C) and to the full scale production 1.4509 ferritic stainless steel in majority of cases.

The corrosion properties of the ferritic stainless steel of the invention were evaluated by using potentiodynamic polarization measurements to determine the pitting potential in a sodium chloride NaCl) solution and record anodic polarization curves in sulphuric acid. The pitting potential ($E_{pt}$) was evaluated in 1 M NaCl at a test temperature of 25° C. with the samples of the heat A and 1.4509 that were wet ground to 320 grit and left in air for at least 18 hours prior to testing. Anodic polarization at a scan rate of 20 mV/min was started at −300 $mV_{SCE}$, and the pitting potential and repassivation potential ($E_{rp}$) were evaluated at a current density of 100 μA/cm$^2$. Three samples were measured on each steel grade and the exposed surface area was 1 cm$^2$. Table 8 shows the pitting potential ($E_{pt}$) and repassivation potential ($E_{rp}$) in 1 M NaCl at 25° C. for heat A and 1.4509.

TABLE 8

| Heat | $E_{pt}$ [$mV_{SCE}$] | $E_{rp}$ [$mV_{SCE}$] |
|---|---|---|
| A | 377 ± 46 | −76 ± 8 |
| 1.4509 | 254 ± 25 | −139 ± 46 |

Anodic polarization curves were recorded in 5% sulfuric acid ($H_2SO_4$) at a test temperature of 30° C. with the samples of the heat A and 1.4509, which samples were wet ground to 320 grit directly prior to measurements. Anodic polarization at a scan rate of 20 mV/min was started at −750 $mV_{SCE}$ after a hold time at 10 min. In order to reach the passive region the critical current density ($i_c$) must be exceeded. The lower the critical current density is, the lower the maximum corrosion rate. The transpassive potential ($E_{tr}$) was evaluated at a current density of 100 μA/cm$^2$. Two samples were measured on each steel grade and the exposed surface area was 1 cm$^2$. Table 9. shows the critical current density ($i_c$) and transpassive potential ($E_{tr}$) in 0.5% sulfuric acid ($H_2SO_4$) at the temperature of 30° C. for heat A and 1.4509.

TABLE 9

| Heat | $i_c$ [mA/cm$^2$] | $E_{tr}$ [$mV_{SCE}$] |
|---|---|---|
| A | 0.8 | 962 |
| 1.4509 | 4.4 | 787 |

The work leading to this invention has received funding from the European Community's Research Fund for Coal and Steel (RFCS) under grant agreement No. RFSR-CT-2009-00018.

The invention claimed is:

1. Ferritic stainless steel having enhanced temperature strength and good resistance to cycle fatigue, creep and oxidation, for components such as automotive exhaust manifolds, characterized in that the steel contains in weight 0.007-0.03% carbon, 0.05-2% silicon, 0.5—less than 0.8% manganese, 18-19% chromium, greater than 1.1-2% molybdenum, less than 0.2% titanium, 0.3-1% niobium, 1-2% copper, less than 0.03% nitrogen, 0.004-0.005% boron, the rest of the chemical composition being iron and inevitable impurities occurring in stainless steels, and the proof strength $R_{p0.2}$ is 450-550 MPa, and in that the pitting potential ($E_{pt}$) in 1 M sodium chloride (NaCl) at the temperature of 25° C. is about 300-450 mVSCE and that the trans passive potential ($E_{tr}$) in 0.5% sulphuric acid ($H_2SO_4$) at the temperature of 30° C. is about 900-1000 $mV_{SCE}$, and wherein the niobium functions to increase strength by solid solution hardening and improve creep resistance by forming fine dispersion of Laves phase $Fe_2Nb$.

2. Ferritic stainless steel according to claim 1, characterized in that the stainless steel contains optionally less than 0.3 weight % aluminum, less than 0.5 weight % vanadium, less than 0.5 weight % zirconium, less than 4 weight % tungsten, less than 1 weight % of cobalt, less than 1 weight % of nickel, and REM less than 0.01 weight %.

3. Ferritic stainless steel according to claim 1, characterized by a tensile strength $R_m$ of about 570-650 MPa.

4. Ferritic stainless steel according to claim 1, characterized in that the ferritic stainless steel contains 0.007-0.025 weight % carbon content.

5. Ferritic stainless steel according to claim 1, characterized in that the stainless steel contains 0.007-0.02 weight % carbon.

6. Ferritic stainless steel according to claim 1, characterized in that the ferritic stainless steel contains 1.2-1.8 weight % copper.

7. Ferritic stainless steel according to claim 1, characterized in that the ferritic stainless steel contains less than 0.025 weight % nitrogen.

8. Ferritic stainless steel according to claim 1, characterized in that the stainless steel contains less than 0.02 weight % nitrogen.

9. Ferritic stainless steel according to claim 1, characterized in that the ferritic stainless steel contains greater than 1.1-1.8 weight % molybdenum.

* * * * *